United States Patent [19]

Stanley

[11] Patent Number: 4,911,271

[45] Date of Patent: Mar. 27, 1990

[54] UMBRELLA CARRIER

[76] Inventor: Joseph B. Stanley, 30 Bay Spring Ave., Barrington, R.I. 02806

[21] Appl. No.: 315,672

[22] Filed: Feb. 27, 1989

[51] Int. Cl.[4] ..... A45C 13/40

[52] U.S. Cl. ..... 190/102; 294/149

[58] Field of Search ..... 294/137, 141, 142, 146, 294/147, 149–157, 159, 160, 162, 163, 165, 167; 150/109, 111; 190/26, 27, 102, 103, 108; 220/85 R

[56] References Cited

U.S. PATENT DOCUMENTS

| | | | |
|---|---|---|---|
| 577,668 | 2/1897 | Stellner | 294/149 |
| 676,310 | 6/1901 | Goldberg | 190/102 |
| 867,403 | 10/1907 | Newson | 190/102 X |
| 2,319,729 | 5/1943 | Ford | 190/102 |
| 4,700,818 | 10/1987 | Orwin | 294/155 X |

FOREIGN PATENT DOCUMENTS

| | | | |
|---|---|---|---|
| 1216833 | 4/1960 | France | 294/146 |
| 1470362 | 2/1967 | France | 294/149 |
| 347220 | 4/1931 | United Kingdom | 190/102 |
| 396926 | 8/1933 | United Kingdom | 190/102 |

*Primary Examiner*—Johnny D. Cherry
*Attorney, Agent, or Firm*—Robert J. Doherty

[57] ABSTRACT

A device for supporting an umbrella preferably against the upstanding side wall of luggage such that individual or extra attention need not be given an umbrella during transit yet position such umbrella in an easily accessible and convenient manner. The device includes a central base having an inner surface provided with a VELCRO-type connector and a downwardly extending web adapted to encircle the umbrella and be in turn connected to the base via such VELCRO connection. In addition, a pair of straps which upwardly extend from the upper portions of such base are utilized to encircle luggage handle connector points to support the device vis-a-vis one of the luggage side walls in the intended manner.

6 Claims, 2 Drawing Sheets

UMBRELLA CARRIER

BACKGROUND AND OBJECTS OF THE INVENTION

This invention relates to a device for suspending articles such as umbrellas from one's luggage in a convenient, simple and easily releasable manner.

A recurrent problem for travelers is carrying an umbrella along with luggage such that the umbrella is available quickly and conveniently during inclement weather periods yet does not present an inconvenience or burden when not needed. Generally, umbrellas are now carried either in one's hand or suspended from one's arm or on occasion laterally positioned on the top surface of luggage between opposed upwardly extending loop carriers when such construction is present or simply simultaneously grasped by one's hand that is also engaged with the luggage handle. Various other ways of carrying an umbrella or other long narrowly-shaped articles are encountered when observing other travelers, but non present the convenience, simplicity, and operative ease that is required for such task.

Accordingly, it would be desirable if a device could be provided which enables the traveler to suspend such umbrella or other article from the luggage in a reliable yet simple manner. In addition, it would be convenient if such device could be quickly yet securely releasably connected to the article being carried and to the luggage in a simple, convenient manner. The present invention accomplishes these various desirable attributes in such a convenient, secure and reliable manner by a device which is generally unobtrusive and further can be fashioned simply and inexpensively from available materials.

These and other objects of the present invention are accomplished by a device for suspending laterally extending articles such as an umbrella from articles such as luggage having a pair of laterally spaced suspension points formed by a member such as a handle, said device comprising a centrally disposed generally planar base having opposed inner and outer surfaces and upper and lower edges and wherein said inner base surface is provided with a pile covering from a loop and pile connector set, a material web downwardly longitudinally extending from the lower edge of said base, said web adapted to be upwardly inwardly turned upon itself to form an encircling loop through which such article is adapted to laterally extend, said web terminating in a laterally extending band having at least portions of the inner face thereof provided with the loops of said loop and pile connector set whereby said web may be maintained in its article encircling position by the grasping interaction of said loop and pile connector set, said device further including a pair of separate straps each having a first end and a second end with said first ends attached to said base at laterally separated locations proximal the opposed side edges thereof and adapted to upwardly extend from said base so as to separately encircle said article suspension points and be turned down so as to create a pair of separate loops, the second end terminal surfaces having loops for loop and pile connection to the pile of the inner surface of said base whereby said device is releasably suspended from said article.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
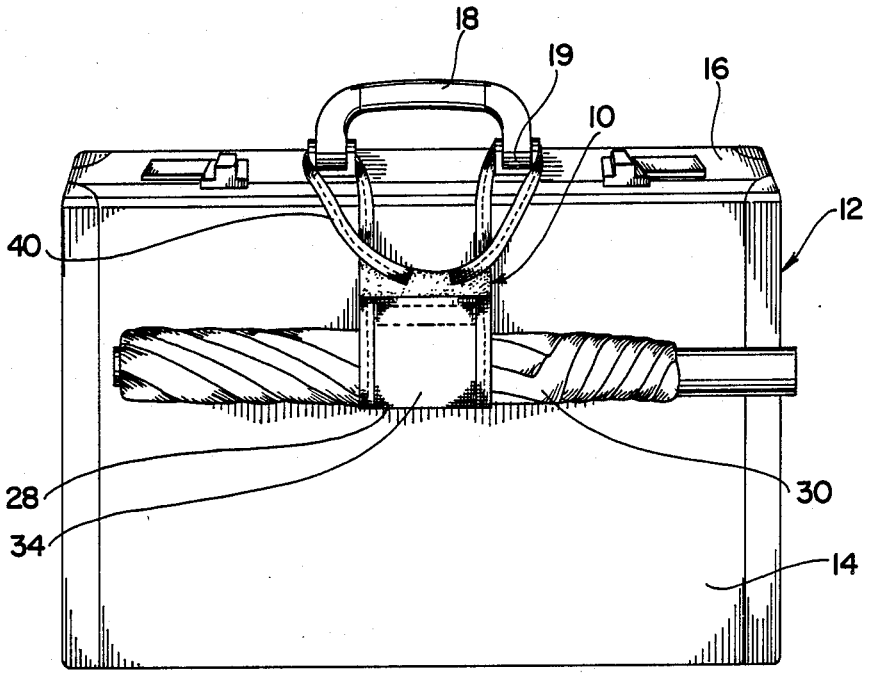
FIG. 1 is a side elevational view showing the device of the present invention utilized to connect an umbrella to a conventional piece of luggage having a single handle upstanding from the upper surface thereof.

Referring now to the drawings and more particularly FIG. 1, the device 10 of the present invention is pictured in a use position upon a conventional luggage piece 12. Such luggage piece 12 includes opposed vertically oriented side walls 14 and a top wall 16 from which a handle 18 upwardly extends. The handle 18 is in turn connected to the topwall 16 at two laterally extending connector points 19 with a conventional hinge and pintle construction. It should be brought out, however, that other types of handle or strap connectors are widespread and common in conveying luggage and need not necessarily extend form the top wall but may extend from the side walls thereof. The important feature being that such spaced connectors exist, and the device of the present invention is particularly adapted to be mounted from such spaced connector points regardless of the particular type construction which they embody for any particular piece of luggage.

Figure 2:
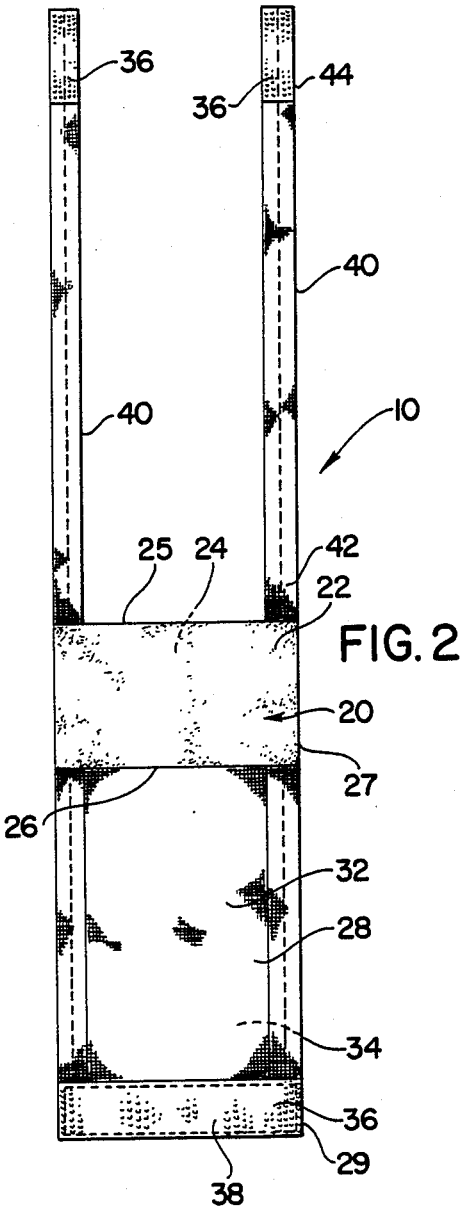
FIG. 2 is a top plan view of one form of the device of the present invention.

As best shown in FIG. 2, the device 10 of the present invention is formed of flexible material and is of an overall planar configuration. Generally, the device is formed from a strong fabric material but may include other materials and may even be formed of cut or otherwise molded plastic, leather, cloth or the like as long as the overall attributes previously and hereinafter explained are included. Such device 10 includes a generally rectangular base 20 having opposed inner and outer surfaces 22 and 24 respectively. Such base further includes an upper edge 25, a lower edge 26, and laterally separate side edges 27. The inner face 22 of the base 20 is preferably provided with one portion of a loop and pile connector set, that is, the two-part generally fabric material referred to under the tradename VELCRO, for a purpose which will hereinafter be apparent.

A web 28 which is adapted to encircle the umbrella body portion 30 or other article, downwardly longitudinally extends from the lower edge 26 of the base 20. Generally such web is an integral continuation of the fabric material from which the base 20 is formed and includes an inner surface 32 and an outer surface 34. Connector loops 36 are provided along a laterally extending band 38 at the web 28 lower terminal portion 29 on the inner face 32. The term "band" is used in its most general sense, and all that is required here is that sufficient loops 36 be provided in the web 28 terminal portion 29 such that a secure yet easily releasable connection may be provided when the web 28 is folded upon itself to form a loop encircling the umbrella 30 and disposed such that the loops 36 interengage the pile fabric provided on the inner surface 22 of the base 20. Generally, the band 38 is of a longitudinal height approximating about half that of the inner surface 22 which is provided with the pile covering, but other operative ratios may be utilized—the important feature being that enough area is provided for a secure yet releasable loop and pile engagement, and that a significant portion of the inside area 22 provided with the pile is available at the upper extremity thereof for a purpose which will hereinafter be apparent.

The device 10 is further provided with a pair of upwardly extending separate straps 40 connected to the base 20 preferably at the upper edge 25 thereof and proximal the side edges 26. These first straps 40 include a first end 42 which is connected to the base 20 and a terminal or free end 44. One of the surfaces of each terminal end 44 is also provided with loops 36 such that a loop and fabric connector is formed between such terminal ends 44 and the base 20 inner surface 22. As best pictured in FIG. 1, the straps 40 are adapted to upwardly encircle the laterally spaced handle connector points 19 of the luggage 12 with the terminal ends 44 thereof firmly placed in contact with upper portions of the inner surface 22, that is, portions of the surface 22 above the connecting area between the loop and pile taken up by the web terminal portion 29.

In this manner, the umbrella or other article is encircled and cradled or supported along a laterally extending area on the luggage side 14 in an inconspicuous and out of the way location yet freely available for use when necessary. When desired to use the umbrella, the web 28 may simply be disconnected from the base face 22 which removes the umbrella from its depicted attitude. When utilizing an umbrella, there is no need to disconnect the straps 40 since the device may remain in an unoccupied position. The entire device 10 may also be removed from the luggage by disconnecting the straps 40 from their connection to the upper portions of the face 22. Similarly, the umbrella may be held by the encircling or looped web 28 and the straps removed from the particular luggage piece shown in the drawings and used to connect or suppot the umbrella from a similar piece of luggage or from other laterally spaced support points, e.g. coat hooks outwardly extending from a wall or the like.

Figure 3:
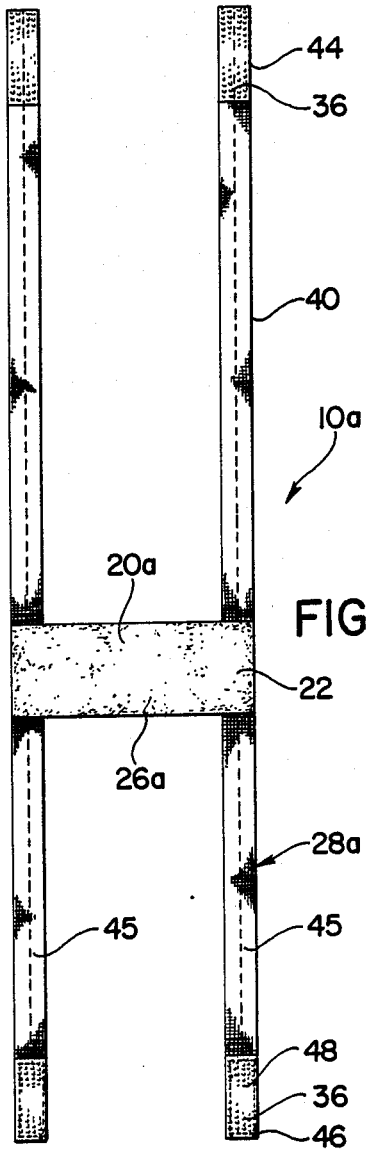
FIG. 3 is a top plan view similar to FIG. 2 but showing an alternate embodiment.

Turning now to FIG. 3, a modification of the device 10a of the present invention is shown wherein a weg 28a is formed by a pair of downwardly extending second straps 45. Such straps 45 are preferably connected to the base 20a at a lower edge 26a thereof. In the embodiment shown in FIG. 3, the web 20a is of a longitudinal height less than that shown in FIG. 2 since there is a lesser need for contact area provided with the pile portion 22 of the loop and pile connector set. In this regard, the lower inside surfaces of the terminal portion 46 of the second straps 45 are provided with a band 48 including an adequate number of loops 36 so that the straps 45 may be upwardly folded upon themselves, and the terminal portions 46 thereof presented in contact with the pile surface present on the base 20a. Similarly, the straps 40 in this embodiment are adapted to be downwardly folded and presented in contact with pile areas provided on the base 20a unoccupied by the terminal portions 46 of the second straps 45. Furthermore, it should be pointed out that a base area 20 of the same size and extent as that provided in FIG. 2 could be used on FIG. 3 as well.

Figure 4:
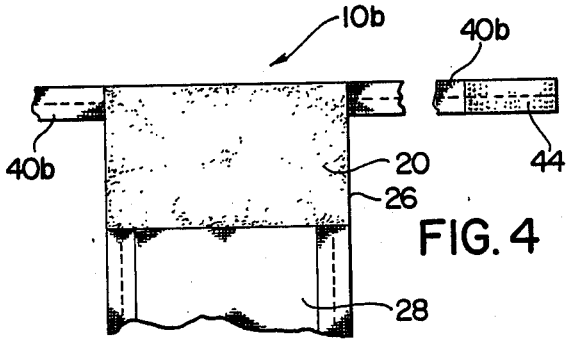
FIG. 4 is a partial plan view showing a still further embodiment thereof.

Turning now to FIG. 4, a further embodiment of the invention is shown wherein the straps **40*b* towardly laterally extend from the opposed side edges 26 of the base 20. Otherwise, the operation of the device 10*b* is essentially the same as that described in FIGS. 1–3** of the drawings.

It may thus be apparent that a device which accomplishes the objectives of the present invention in a simple, inexpensive and readily usable manner has been achieved.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for suspending a laterally extending article such as an umbrella from equipment such as luggage having a pair of laterally spaced suspension points formed by a member such as a handle, said device comprising a centrally disposed generally planar base having opposed inner and outer surfaces, opposed side edges and upper and lower edges and wherein said inner base surface is provided with a pile covering from a loop and pile connector set, a material web having opposed inner and outer faces downwardly longitudinally extending from the lower edge of said base, said web adapted to be upwardly inwardly turned upon itself to form an encircling geometric loop through which such article is adapted to laterally extend and so as to form an article encircling position for such web, said web terminating in a laterally extending band having at least portions of the inner face thereof provided with the loops of said loop and pile connector set whereby said web maybe maintained in its article encircling position by the grasping interaction of said loop and pile connector set, said device further including a pair of separate straps each having a first end and a second end with said first ends attached to said base at laterally separated locations proximal the opposed side edges thereof and adapted to upwardly extend from said base so as to separately encircle said equipment suspension points and be turned down so as to create a pair of separate geometric loops, the second ends thereof having terminal surfaces in turn having material loops for loop and pile connection to said pile covering of the inner surface of said base whereby said device is releasably suspended from said equipment.

2. The device of claim 1, said strap second end terminal surfaces having inner and outer face surfaces, the material loops provided on said straps being positioned on the inner terminal face surfaces thereof.

3. The device of claim 1, said web being a continuous material extension of said base.

4. The device of claim 1, said web formed by a second pair of separate straps downwardly extending from said base lower edge at laterally separated positions proximal the side edges thereof, said second straps terminating in inner surface portions having material loops positioned thereon.

5. The device of claim 1, said straps attached to the base proximal the upper edge of the base laterally outwardly extending from the side edges thereof.

6. The device of claim 1, wherein the inner base surface is provided with material loops and both the web and the strap second end terminal surfaces with pile from said loop and pile connector set.

* * * * *